US008282199B2

(12) United States Patent
Fascio

(10) Patent No.: US 8,282,199 B2
(45) Date of Patent: Oct. 9, 2012

(54) REFILLABLE/RECYCLABLE INK CARTRIDGE

(75) Inventor: Carlo Fascio, Maple (CA)

(73) Assignee: Enviro Ink Delivery Systems Corp. (CA)

( * ) Notice: Subject to any disclaimer, the term of this patent is extended or adjusted under 35 U.S.C. 154(b) by 0 days.

(21) Appl. No.: 12/672,053

(22) PCT Filed: Aug. 4, 2008

(86) PCT No.: PCT/CA2008/001426

§ 371 (c)(1),
(2), (4) Date: Aug. 2, 2011

(87) PCT Pub. No.: WO2009/018661

PCT Pub. Date: Feb. 12, 2009

(65) Prior Publication Data

US 2011/0279588 A1 Nov. 17, 2011

(30) Foreign Application Priority Data

Aug. 3, 2007 (CA) ..... 2596123

(51) Int. Cl.
*B41J 2/175* (2006.01)

(52) U.S. Cl. ..... 347/86

(58) Field of Classification Search ..... 347/84, 347/85, 86
See application file for complete search history.

(56) References Cited

U.S. PATENT DOCUMENTS

| | | | | |
|---|---|---|---|---|
| 5,359,356 | A * | 10/1994 | Ecklund | 347/86 |
| 5,581,287 | A | 12/1996 | Baezner et al. | |
| 6,010,210 | A * | 1/2000 | Wilson et al. | 347/85 |
| 6,067,906 | A * | 5/2000 | Ryan et al. | 101/335 |
| 6,145,973 | A | 11/2000 | Wu et al. | |
| 6,243,115 | B1 * | 6/2001 | Baker et al. | 347/85 |
| 6,810,803 | B2 * | 11/2004 | Hashimoto et al. | 101/335 |
| 2004/0145638 | A1 | 7/2004 | Martinez-Pacheco | |
| 2005/0157099 | A1 | 7/2005 | Silverbrook et al. | |

FOREIGN PATENT DOCUMENTS

WO WO2006026910 A1 9/2005

* cited by examiner

*Primary Examiner* — Anh T. N. Vo
(74) *Attorney, Agent, or Firm* — Jansson Shupe & Munger Ltd.

(57) ABSTRACT

The present invention relates to a refillable, recyclable ink cartridge having a rigid outer casing. The outer casing has a side wall section and first and second end caps. At least one ink compartment is defined between the side wall section and one or more interior walls. A plunger located in an end of each ink compartment remote from the ink outlet. The plunger is pushed through the ink towards the ink outlet by air pressure or other suitable biasing means.

13 Claims, 17 Drawing Sheets

ADJUSTABLE LOCKING TABS 200
210
211
212
213
204
201
202
300
ADJUSTABLE LOCKING TAB (TYPICAL)
1 Litre
680 mil
360 mil
CARTIDGES FOR 680 mil PRINTERS
CARTIDGES FOR 360 mil PRINTERS

SECTION "A"-"A"

SECTION "B"-"B"

REFILLABLE/RECYCLABLE INK CARTRIDGE

FIELD OF THE INVENTION

The present invention relates generally to ink cartridges for large format ink jet printers that are refillable and/or recyclable.

BACKGROUND OF THE INVENTION

In large format ink jet printers, the ink supply is stored in one or more ink cartridges remote from the moving print head. The provision of a controlled pressure to the ink is necessary in order to achieve the desired ink transfer from the ink cartridge to the print head.

Currently available ink cartridges have a rigid outer plastic housing with a flexible ink container in the form of a bag or bladder filled with ink in the interior of the housing. The interior of the housing is pressurized to transfer the ink. Cartridges on the market can transfer up to 90% of the ink from the ink container to the print head. The remaining 10% of the ink and the cartridge are typically disposed of into the garbage for dumping into landfills. Some estimates suggest 400 million ink cartridges are dumped into landfills every year.

There is a need for a refillable and/or 100% recyclable ink cartridge as well as cartridges that hold larger volumes of ink. For every 100,000 used cartridges refilled, 9,599 kilograms of aluminum, 40 tons of plastic and 1,000,000 liters of oil can be saved.

SUMMARY OF THE INVENTION

In accordance with the present invention, the present invention provides an ink cartridge having a rigid outer casing, at least one ink compartment provided within the outer casing, an ink outlet connected to the at least one ink compartment, means to exert pressure on the ink in the at least one ink compartment to enable pressurized ink to be delivered to the print head. In the preferred embodiment all of the components of the cartridge are made of recyclable materials. In a further embodiment the ink cartridge of the present invention is refillable.

In one aspect, the outer casing has a side wall section and first and second end caps. At least one ink compartment is defined between the side wall section and one or more interior walls. The means to exert pressure on the ink includes a plunger located in an end of each ink compartment remote from the ink outlet. The plunger is pushed through the ink towards the ink outlet by air pressure or other suitable biasing means.

In another aspect, one or more deformable bags are provided having at least one compartment for holding the ink and a pressurizable container substantially surrounding at least one side of the bag for exerting fluid pressure on the bag so that pressurized ink is delivered to the print head.

Further features of the invention will be described or will become apparent in the course of the following detailed description.

BRIEF DESCRIPTION OF THE DRAWINGS

Embodiments of the invention are shown in the drawings, wherein.

DETAILED DESCRIPTION OF THE PREFERRED EMBODIMENTS

Figure 1:
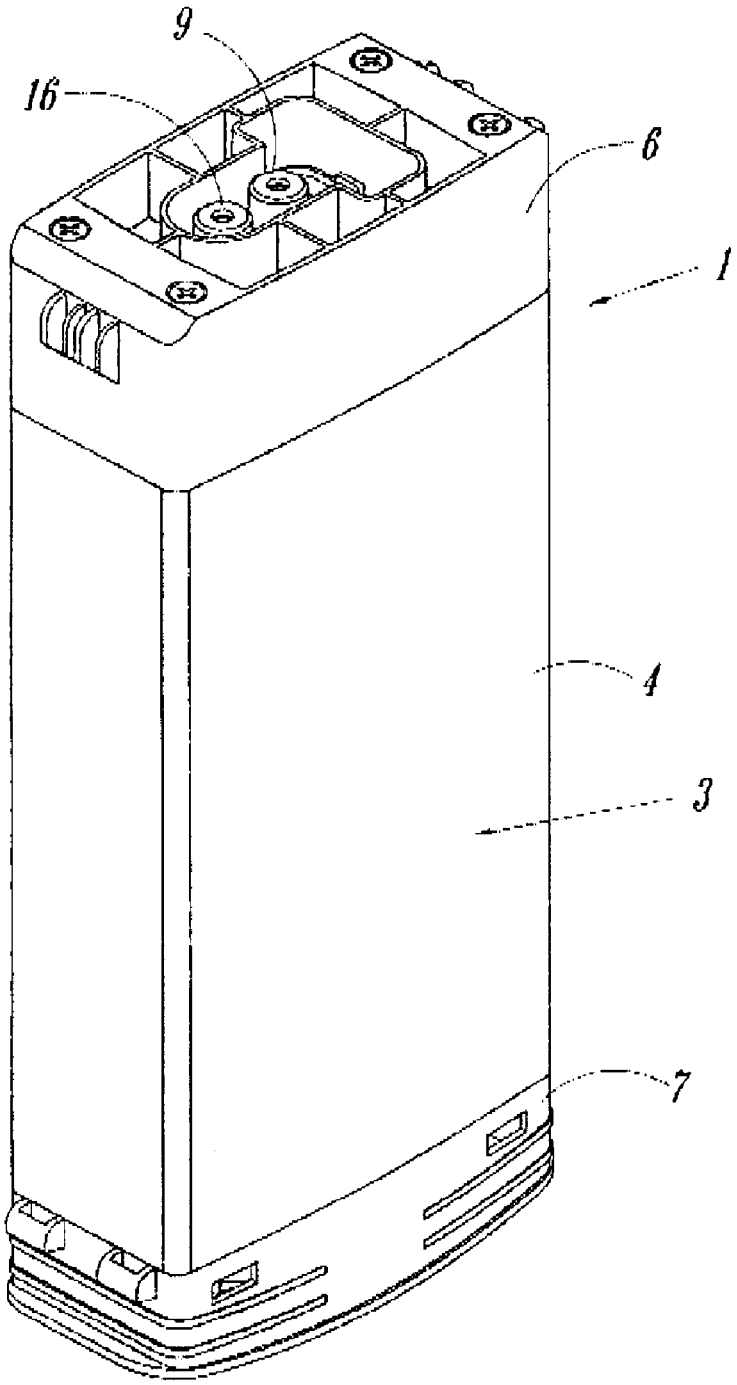
FIG. 1 is a perspective view of a one embodiment of an ink cartridge according to the present invention.

Referring to FIG. 1 a perspective view of a one embodiment of an ink cartridge, generally indicated at 1, according to the present invention is illustrated. The ink cartridge 1 may be refillable and is preferably recyclable. The ink cartridge 1 has an outer casing, generally indicated at 3, having a side wall section 4 and first and second end caps 6, 7. In the embodiment illustrated the side wall section 4 has a generally rectangular cross section.

Figure 2:
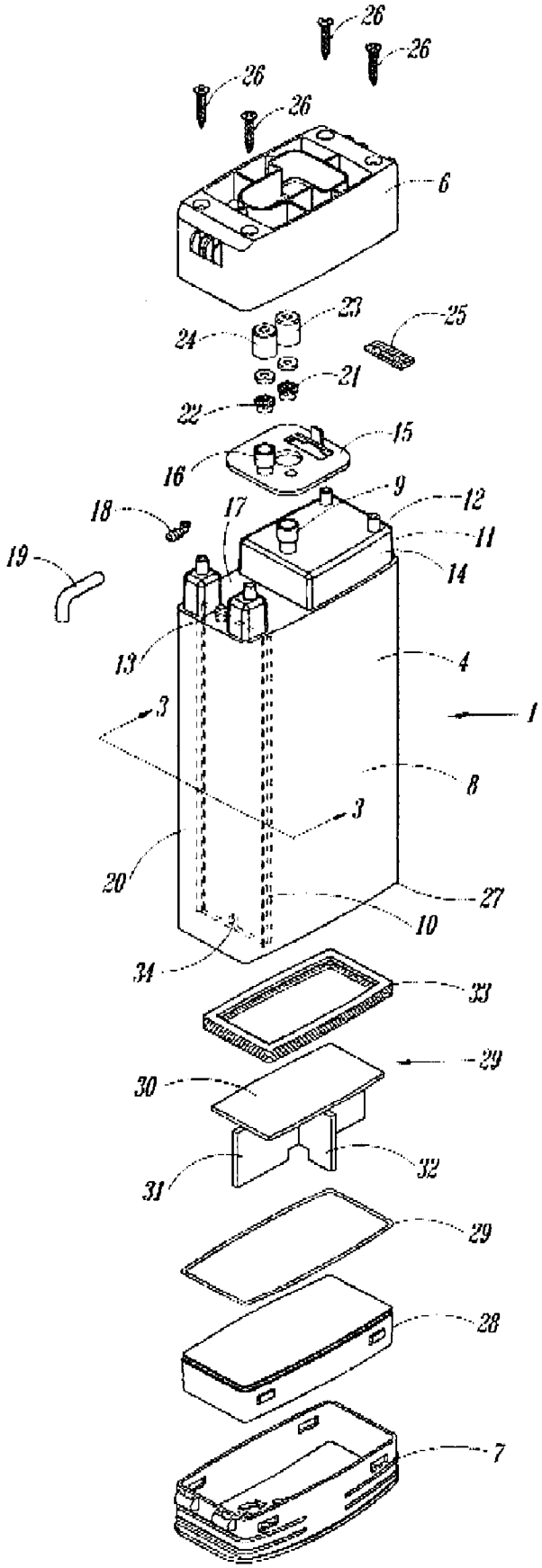
FIG. 2 is an assembly drawing of one embodiment of the ink cartridge of FIG. 1 with an outer casing and an internal ink compartment with a generally rectangular cross section and with a sealed, air activated plunger.
Figure 3:
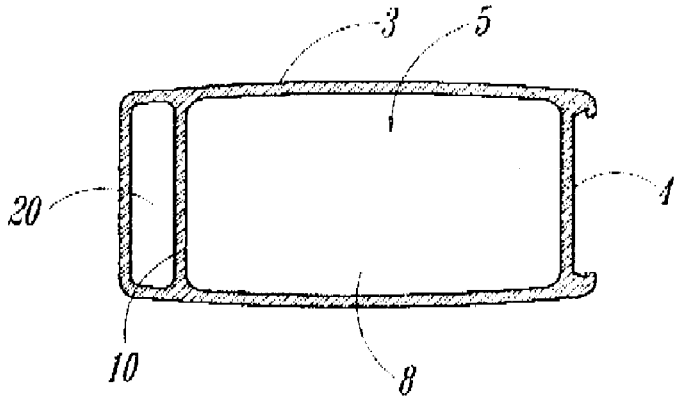
FIG. 3 is a cross-section of the ink cartridge of FIG. 2 through line 3-3

As shown in FIGS. 2 and 3 within the interior 5 of the outer casing 3 of the ink cartridge 1 defined by side wall section 4 and end caps 6, 7 is at least one ink container, generally indicated at 8. In the embodiment illustrated the ink container 8 has a generally rectangular cross section and runs the length of the interior 5 of the outer casing 3 between the side wall section 4 and an interior wall 10. In the embodiment shown, an ink outlet 9 communicates with the ink container 8 and extends through a first end cap 6. When the ink cartridge 1 is installed into the printer, means on the printer engage with the ink outlet 9 to facilitate the flow of ink to the print head as set out below.

In the embodiment illustrated one end 11 of the wall section 4 is sealed by top section 12 with a first lower section 13 and a raised section 14. Ink outlet 9 extends from the raised portion 14 on top section 12. A plate 15 fits over ink outlet 9 and extends over part of the first lower section 13. The plate 15 contains an upstanding inlet tube 16 above the space 17 between the plate 15 and the lower section 13. Tubing 18, 19 connects the inlet tube 16 with a second compartment 20 defined by the side wall section 4 and interior wall 10. Self sealing membranes 21, 22 cover the ink outlet 9 and inlet tube 16 and are held in place by covers 23, 24. A programmable chip 25 is placed on plate 15 that interfaces with the printer. The program preferably enables the printer to determine the amount of ink remaining in the ink compartment based on the ink delivered to the print head (not shown). The chip 25 may also contain programming to interface with an ink filling machine to permit the cartridge to be refilled and monitor the number f times it has been refilled. End cap 6 is fixed to the top section 12 of the wall section 4 by screws 26 or other suitable fastening means. In a preferred embodiment the screws 26 and all of the other components other than the chip 25 are made of recyclable materials.

The other end 27 of the wall section 4 is open. End cap 7 holds a base 28 and seal 29 in sealing engagement with the other end 27 of wall section 4. A plunger 29 having a plate portion 30 with depending fins 31, 32 fits within the bottom of the ink compartment 8. Plate portion 30 is substantially the size and shape of the cross-sectional area of ink compartment 8. Seal 33 on the side of plate portion 30 facing into the ink compartment prevents ink flowing around the plunger 29. As air or another gas is injected under pressure through inlet tube 16 into second compartment 20, which communicates through hole 34 at the base of interior wall 10, plunger 29 is pushed through compartment 8 causing ink to be ejected through ink outlet 9. Fins 31, 32 ensure that plunger 29 moves with plate portion 30 generally perpendicular to the wall section 4.

As noted above, all the components of the ink cartridge 1 (except chip 25) including the side wall section 4 and first and second end caps 6, 7 of outer casing 3, plate 15, ink outlet 9, inlet tube 16 and associated tubing 18,19, covers 23, 24, base 28 and plunger 29 are preferably formed of a recyclable material. Recyclable materials include Biaxially oriented polypropylene, Chlorotrifluoroethylene, Crystaillized PET, Ethylene-ethyl acrylate, Expaned Polystyrene, Ethylene-vinyl acetate, Ethylene-vinyl alcohol, High-density polyethylene, High-impact polystyrene, Low-density polyethylene, Linear Low-density polyethylene, Oriented Polypropylene, Metallocene polyethylene, a polyamide, poly(ethylene naphthalate, Polycarbonate, Polyethylene, polyethylene terephthalate, Polyethyleneterephthaiateglycol, Polypropylene, Polystyrene, Polytetrafluoroethylene, Polyvinyl acetate, Polyvinyl chloride, Polyvinyllidene chloride), Polyvinyl alcohol, Ionomer, Phenolic polymers, Fluorocarbon, Acrylonitrile-butadiene-styrene, Thermoset plastics, Thermoset epoxy, polychlorotrifluoroethylene, Acrylonitrile Copolymer, Polyurethanes, Cellulosics, metals (i.e steel aluminium, copper), fibers (i.e paper, cardboard,). By making the cartridge components out of recyclable material it is 100% recyclable when its useful life is completed. To lengthen the useful life of the ink cartridge 1, and make it more environmentally friendly, it is designed to be refillable up to 1500 times with preferably water based inks.

The side wall section 4 is preferably polyethylene having a relatively thin wall to minimize the use of material and maximize the interior space for ink compartment 8. The outer casing is extruded and the plunger, end caps and locking tabs are injection molded. The components are then sent for inspection and destruct testing before being assembled.

To fill or refill the cartridge it is visually inspected and then placed into a filling station to be first evacuated then pressure tested with nitrogen. Once the cartridge has passed quality assurance testing the process of filling begins.

Figure 5:
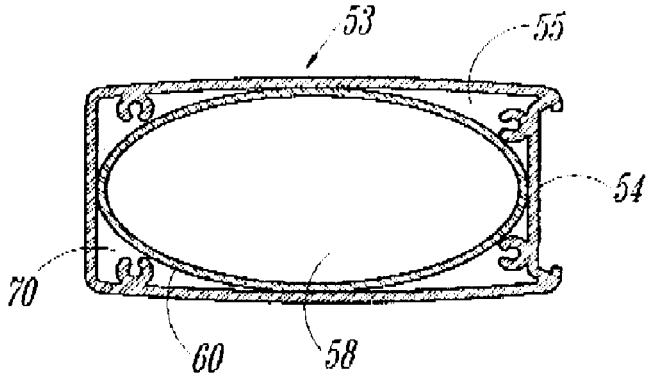
FIG. 5 is a cross-section of the ink cartridge of FIG. 4 through line 5-5
Figure 4:
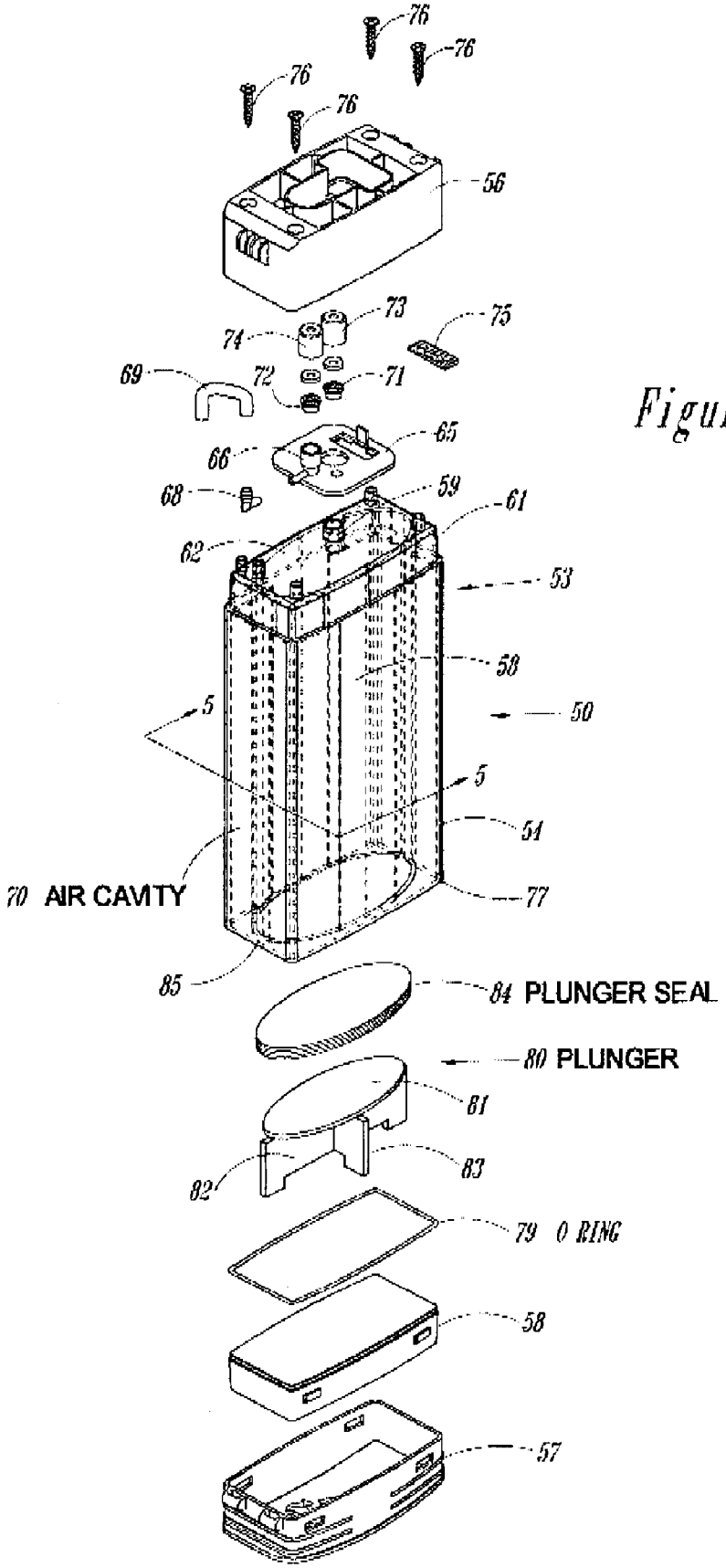
FIG. 4 is an assembly drawing of another embodiment of the ink cartridge of FIG. 1 with an outer casing and an ink compartment with a generally elliptical cross section and with a sealed, air activated plunger.

Another embodiment of an ink cartridge according to the present invention is illustrated in FIGS. 4 and 5. The embodiment shown in FIGS. 4 and 5 is similar to the ink cartridge shown in FIGS. 2 and 3.

The ink cartridge 50 has an outer casing, generally indicated at 53, having a side wall section 54 and first and second end caps 56, 57. In the embodiment illustrated the side wall section 54 has a generally rectangular cross section. Within the interior 55 of the outer casing 53 of the ink cartridge 50 defined by side wall section 54 and end caps 56, 57 is at least one ink container, generally indicated at 58. In the embodiment illustrated the ink container 58 has a generally elliptical cross section and runs the length of the interior 55 of the outer casing 53 between the side wall section 54 and an interior wall 60. In the embodiment shown, an ink outlet 59 communicates with the ink container 58 and extends through a first end cap 56. When the ink cartridge 50 is installed into the printer means on the printer engage with the ink outlet 59 to facilitate the flow of ink to the print head as set out below.

In the embodiment illustrated one end 61 of the wall section 54 is sealed by top section 62. Ink outlet 59 extends from the top section 62. A plate 65 fits over ink outlet 59. The plate 65 contains an upstanding inlet tube 66. Tubing 68, 69 connects the inlet tube 66 with a second compartment 70 defined by the side wall section 54 and interior wall 60. Self sealing membranes 71, 72 cover the ink outlet 59 and inlet tube 66 and are held in place by covers 73, 74. A programmable chip 75 is placed on plate 65 that enables the printer to determine the amount of ink remaining in the ink compartment based on the ink delivered to the print head (not shown). End cap 56 is fixed to the top section 62 of the wall section 54 by screws 76 or other suitable fastening means.

The other end 77 of the wall section 54 is open. End cap 57 holds a base 78 and seal 79 in sealing engagement with the other end 77 of well section 54. A plunger 80 having a plate portion 81 with depending fins 82, 83 fits within the bottom of the ink compartment 58. Plate portion 81 is substantially the size and shape of the cross-sectional area of ink compartment 58. Seal 84 on the side of plate portion 81 facing into the ink compartment prevents ink flowing around the plunger 80. As air or another gas is injected under pressure through inlet tube 66 into second compartment 70, which communicates through hole 85 at the base of interior wall 60, plunger 80 is pushed through compartment 58 causing ink to be ejected through ink outlet 59. Fins 82, 83 ensure that plunger 80 moves with plate portion 81 generally perpendicular to the wall section 54.

By using an elliptical cross-section for ink compartment 58, the thickness of the side wall section 58 can be increased in areas where under pressure it may otherwise be inclined to bulge causing the seals 79, 84 from losing contact with the adjacent side wall section.

Figure 18:
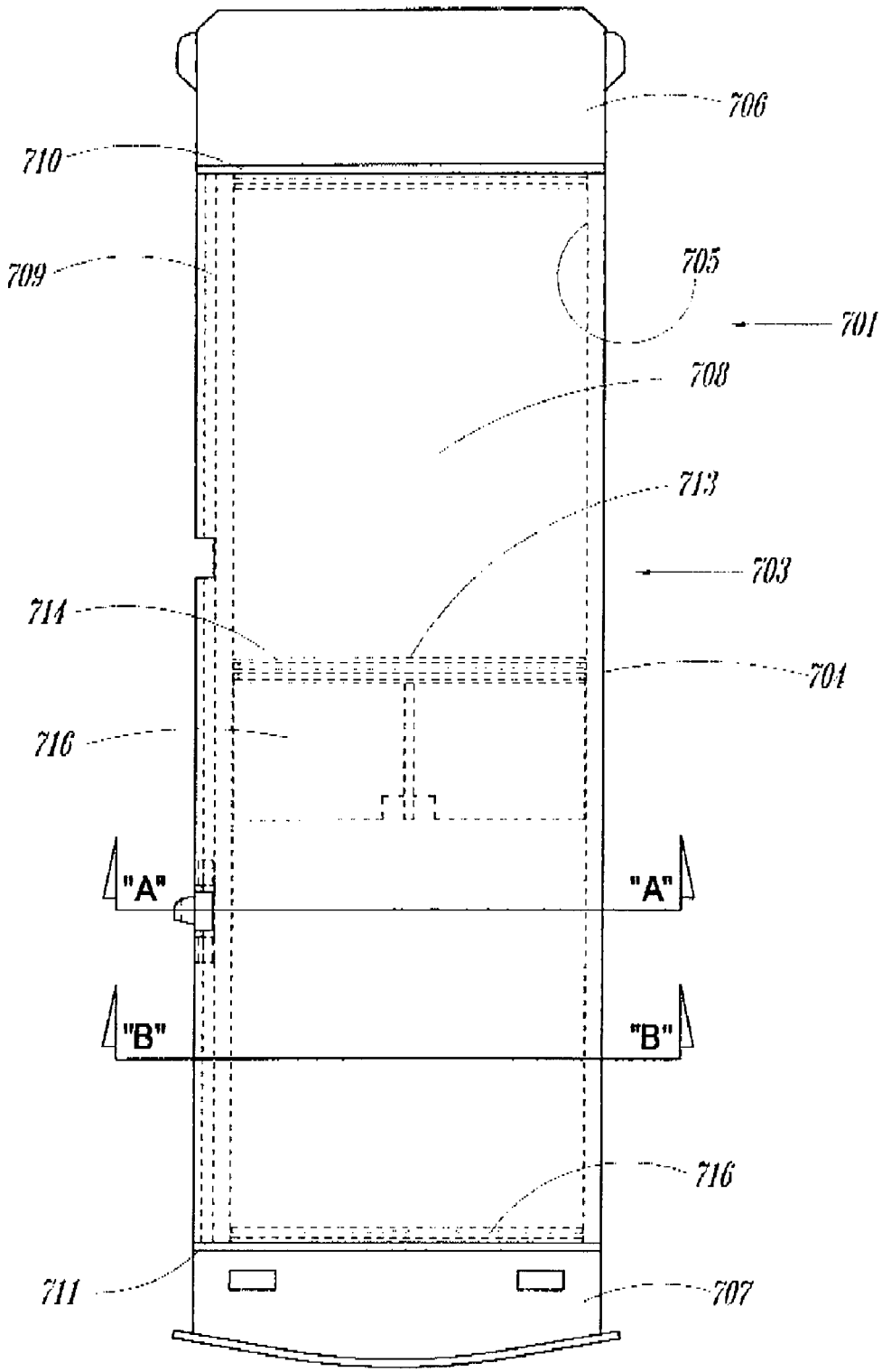
FIG. 18 is a front plan of another embodiment of a refillable, 100% recyclable ink cartridge with an outer casing and an ink compartment with a generally elliptical cross section and with a sealed, air activated plunger similar to FIG. 4.
Figure 19:
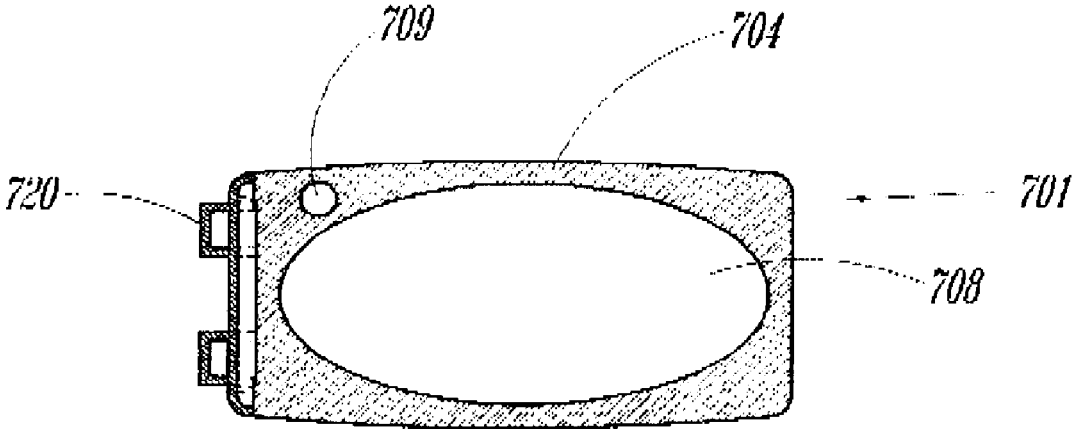
FIG. 19 shows cross-sections of the ink cartridge of FIG. 18 through line A-A and line B-B.
Figure 19:
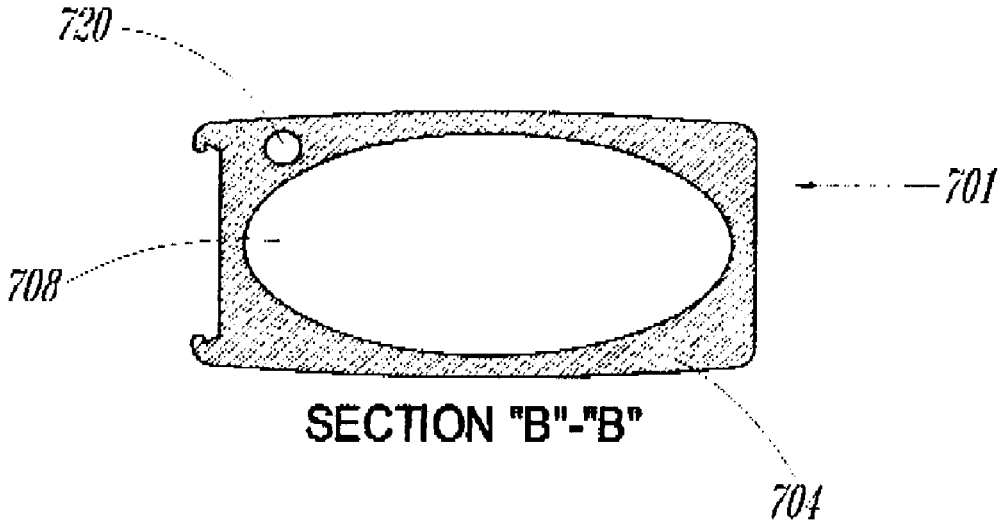

FIGS. 18 and 19 show a variation of the embodiment illustrated in FIGS. 4-5. In this embodiment the ink cartridge 701 has an outer casing, generally indicated at 703, having a side wall section 704 and first and second end caps 706, 707. In the embodiment illustrated the side wall section 704 has a generally rectangular cross section. Within the interior 705 of the outer casing 703 of the ink cartridge 50 defined by side wall section 704 and end caps 706, 707 is an ink compartment 708 having a generally elliptical cross section and running the length of the side wall section 704 of the outer casing 703. A plunger 713 having a plate portion 714 with depending fins 715 fits within the bottom 716 of the ink compartment 708. Plate portion 714 is substantially the size and shape of the cross-sectional area of ink compartment 708. A seal (not shown) on the side of plate portion 716 facing into the ink compartment prevents ink flowing around the plunger 713.

In the embodiment illustrated the side wall section 704 for several ink cartridges is preferably extruded in a long piece and then the side wall section 704 for individual cartridges cut from the long piece. The end cap 706 is preferably injection molded as one piece containing the parts shown in FIG. 4 namely top section 62, ink outlet 59 plate 65, and inlet tube 66. The air cavity 709 in this embodiment is a longitudinal passageway through the wall section 704. One end 710 of passageway 709 is connected to inlet tube 66 and the other end 711 is open into the bottom 716 of the ink compartment 708 below plunger 713.

In this embodiment end cap 57 and base 70 shown in FIG. 4 are injection molded as one piece to form end cap 707 and when assembled end cap 707 is in sealing engagement with the side wall section 704. Adjustable locking tabs 720 are attached to the side wall section as described below with reference to FIG. 8.

Figure 7:
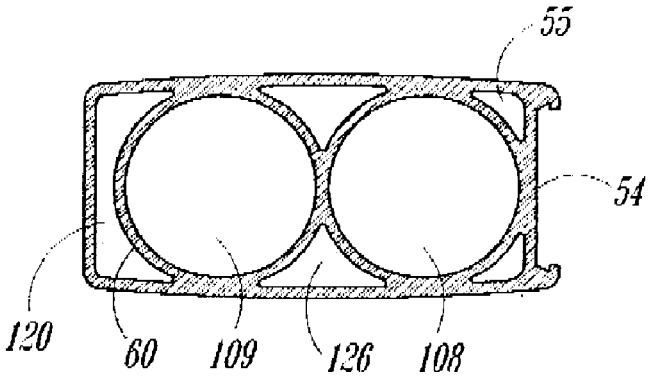
FIG. 7 is a cross-section of the ink cartridge of FIG. 7 through line 6-6
Figure 6:
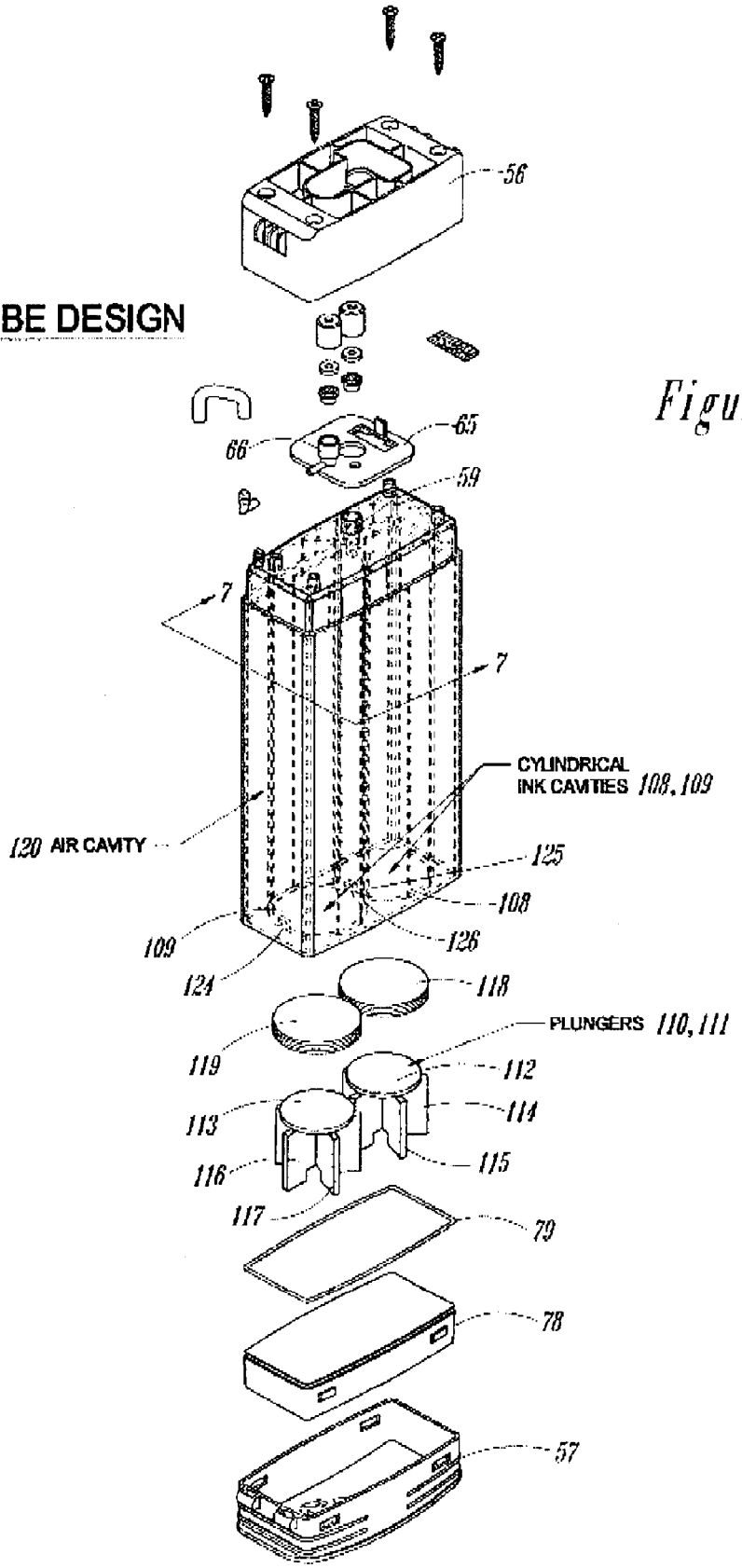
FIG. 6 is an assembly drawing of another embodiment of the ink cartridge of FIG. 1 with an outer casing and a pair of ink compartments with a generally circular cross section and with a pair of sealed, air activated plungers.

FIGS. 6-7 show another embodiment of an ink cartridge according to the present invention similar to the ink cartridge illustrated in FIGS. 4-5. The same parts of the ink cartridges of FIGS. 4-5 and 6-7 are given the same reference numbers. The primary difference with the ink cartridge 50 of FIGS. 4-5 and the embodiment illustrated in FIGS. 6-7 is that there are two cylindrical ink compartments 108,109 having circular cross-sections as best shown in FIG. 7 as opposed to a single ink compartment as shown in FIGS. 4-5. As a consequence there are a pair of plungers 110, 111 each having a plate portion 112, 113 with depending fins 114, 115, 116, 117. The first plunger 110 fits within the bottom of the first ink compartment 100 and the second plunger 110 fits within the bottom of the second ink compartment 109. Plate portions 112, 113 are substantially the size and shape of the cross-sectional area of ink compartments 108, 109. Seals 118, 119 on the side of plate portions 112, 113 facing into the ink compartments prevent ink flowing around the plungers 110, 111. As with the embodiment in FIGS. 4-5, air or another gas is injected under pressure through inlet tube 66 into cavity 120, defined by the side wall section 54 and interior wall 60 in order to move plungers 110, 111. Air from cavity 120 can access the space below plunger 111 through hole 124 at the base of interior wall 60 into the second ink compartment 109. A second hole 125 at the base of adjoining wall 126 between the first and second ink compartments 108, 109 permits the air from cavity 120 to access the space below plunger 110. Plungers 110, 111 are pushed through the first and second ink compartments 109 causing ink to be ejected through ink outlet 59. Ink outlet 59 communicates with both the first and second ink compartments 108, 109.

The movement of the plungers in the embodiments illustrated in FIGS. 2-7 and 18-19 is controlled by utilizing air pressure. However other methods of biasing the plungers to push them through the ink compartments are possible. For example a spring could be located between the bottom of the plunger and the base. Another option is to use an elastic means that is biased to pull the plunger through the ink compartment.

Figures 9A, 9B, 9C:
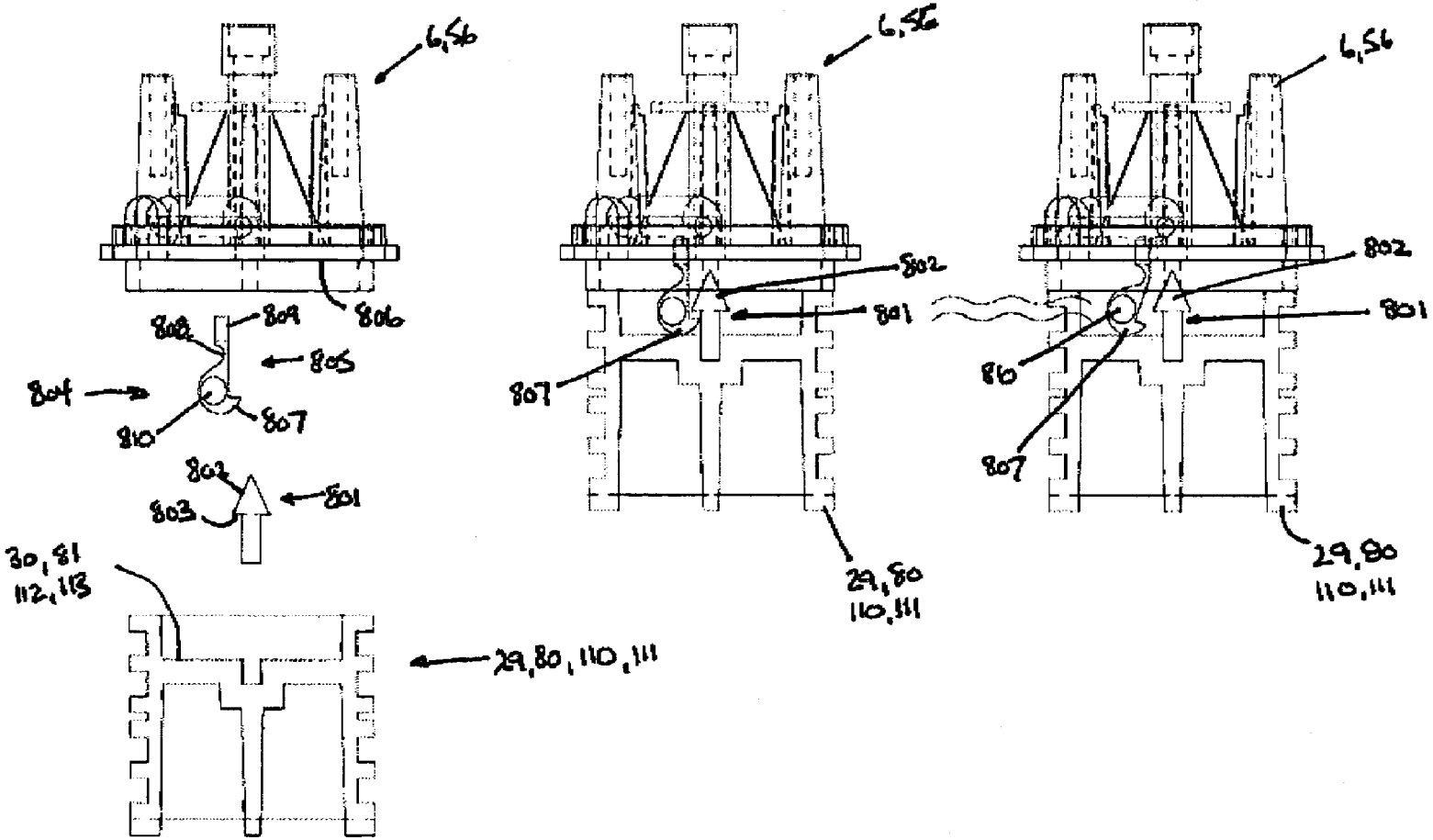
FIG. 9A is an assembly drawing in cross-section of the end cap and plunger(s) of one embodiment of an ink cartridge of the type shown in FIGS. 1,2,4 & 6 showing one embodiment of means for locking the plunger(s) in place after the cartridge is empty of ink.
FIG. 9B is an assembly drawing in cross-section of the end cap and plunger(s) of FIG. 9A showing the plunger(s) locked in place after the cartridge is empty.
FIG. 9C is an assembly drawing in cross-section of the end cap and plunger(s) of FIGS. 9A and 9B showing the plunger (s) being un-locked.

FIGS. 9A,9B,9C show a means of locking the plunger(s) 29, 80, 110, 111 to the end cap 6, 56 of the ink cartridges shown in FIGS. 1-7. Locking the plunger(s) in place after the cartridge is emptied prevents the cartridge from being refilled by unauthorized persons. in the embodiment illustrated an upstanding spear 801 having an arrow head shaped upper portion 802 is provided on the top surface 30, 81, 112, 113 of the plunger 29, 80, 110, 111 and preferably centrally located. The bottom edge 803 of the arrow head shaped upper portion 802 is adapted to be engaged by locking means generally indicated at 804. the locking means 804 illustrated is a locking clip 805 is mounted to the bottom side 806 of the end cap 6,56. In the embodiment illustrated the locking clip 805 is made of a flexible material having a depending hook section 807, hinge section 808 and upper fixed section 809. The depending hook section 807 is pressed to the side as it is contacted by the spear 801 on the plunger 29, 80, 110, 111. Once the bottom edge 803 of the arrow head shaped upper section 802 has passed the hook section 807, the hook section 807 returns to its normal position, locking the plunger in place as shown in FIG. 9B. A metallic member 810 is provided within depending hook section 807. A magnetic means on the ink filling machine (not shown) may be activated when refilling or initially filling the cartridge to pull the depending hook section 807 to the side and unlock the plunger(s) as shown in FIG. 9C.

Figure 8:
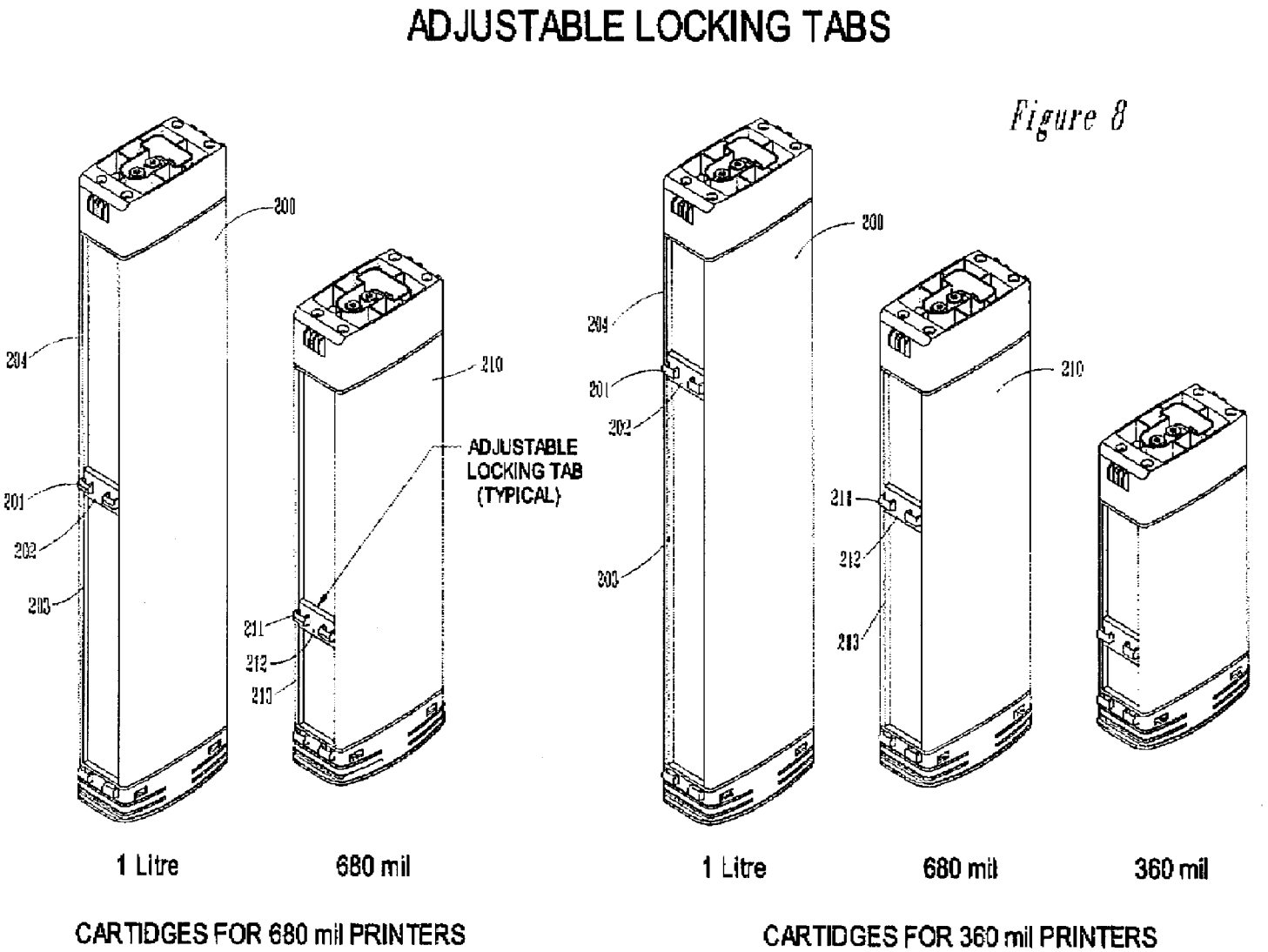
FIG. 8 is a perspective view of different sizes of ink cartridges according to the present invention with adjustable locking tabs.

The cartridges shown in FIGS. 1-7 and 18-19 are intended to be compatible with different sizes of printers and to permit larger volume ink cartridges to be used than provided as OEM equipment by the manufacturer. FIG. 8 shows a series of different sized ink cartridges (one liter, 680 ml and 360 ml) for different sizes of printers (680 ml and 360 ml). In order to enable the one liter ink cartridge 200 for example to fit in a 680 ml or 360 ml printer, locking tabs 201 on the exterior of the side wall section 204 are mounted on a base plate 202 that slides within tracks or slot 203. The locking tabs 201 are positioned to engage with corresponding tabs on the printer. Similarly in order to enable the 680 ml ink cartridge 210 for example to fit in a 680 ml or 360 ml printer, locking tabs 211 on the exterior of the side wall section 214 are mounted on a base plate 212 that slides within tracks or slot 213. The locking tabs 211 are positioned to engage with corresponding tabs on the printer.

The advantages of using the plunger type ink cartridges of the present invention are:

They may be 100% refillable eliminating any impact to landfill.

The computer chip on the plunger type cartridge will allow up to 1,500 refills before the cartridge is re-ground and made back into a new cartridge.

The plunger type cartridges may be 100% recyclable and made from 100% recycled plastic resins.

The plunger type cartridge is designed to hold larger ink volumes than that of the OEM or replacement cartridges. This allows the consumer the ability to lower ink supply costs by buying in larger discounted volumes and eliminating multiple delivery costs.

This larger volume plunger type cartridge is designed to fit in all printing machines allowing the manufacture of the cartridge to lower the amount of different cartridge sizes in inventory, this means that the plunger type cartridge can be filled to its designed maximum milliliters/liters or filled to the consumers desired volume.

Another aspect of the present invention, provides for a refillable, recyclable ink cartridge, that improves on current products that have a deformable bag for holding the ink and a pressurizable container substantially surrounding at least one side of the bag for exerting fluid pressure on the bag so that pressurized ink is delivered to the print head.

Figure 10:
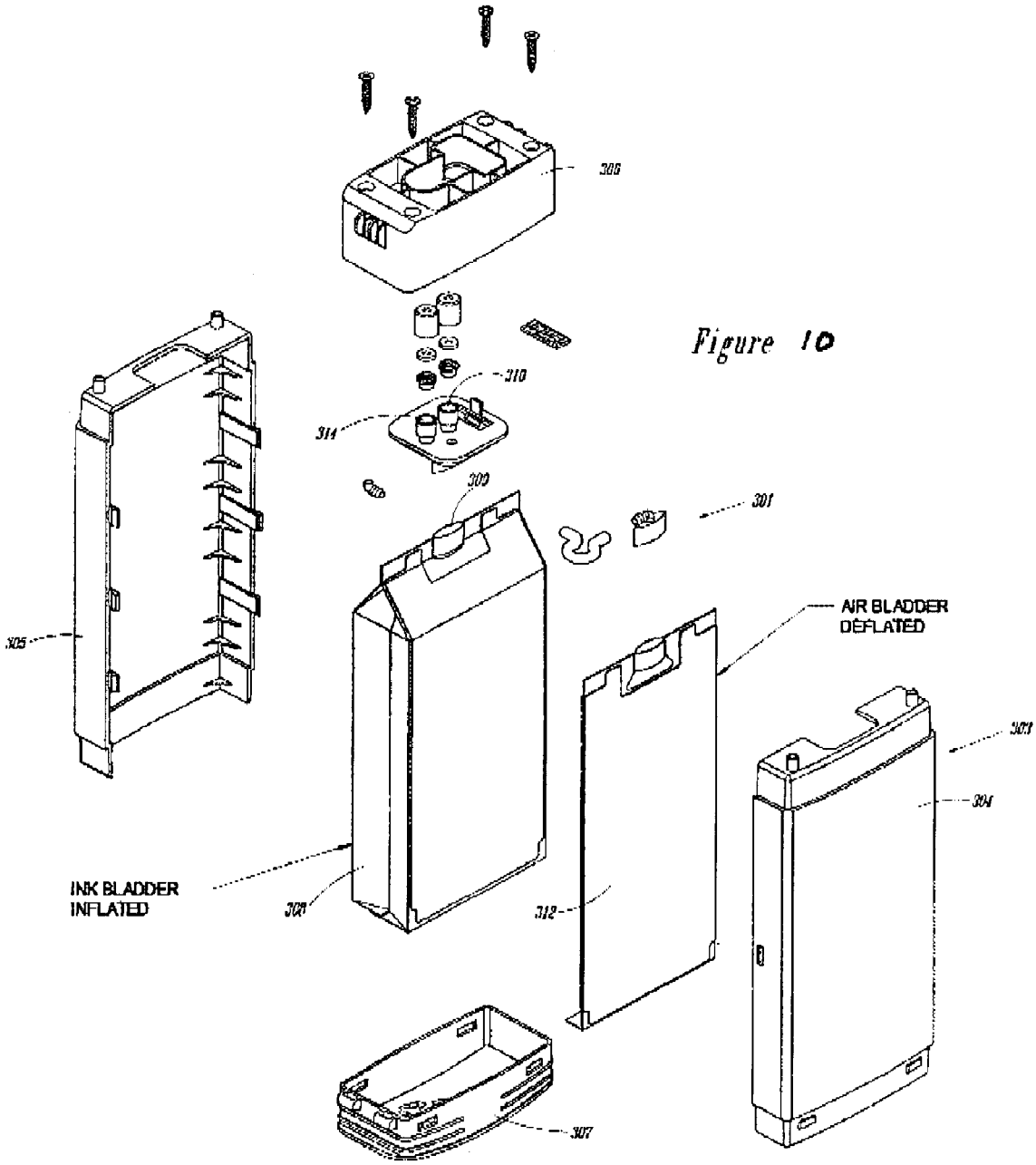
FIG. 10 is an assembly drawing of another embodiment of an ink cartridge having one ink bladder with one air bladder on one side of the ink bladder according to the present invention

FIGS. 10-17 show different embodiments of an ink cartridge utilizing a bladder or bag for the ink with means to provide pressure on the bag to deliver ink under pressure to the print head. In FIG. 10 one embodiment of ink cartridge, generally indicated at 301, according to the present invention is illustrated. The ink cartridge 301 has an outer casing, generally indicated at 303, having a pair of side wall sections 304, 305 and first and second end caps 306, 307. A bladder or bag 308 for the ink is provided within the interior of housing 303. An bag outlet 309 on the ink bladder 308 is connected to an ink outlet 310. A second bag 312 adjacent the ink bladder 308. The second bag 312 is connected to air inlet 314. In order to provide pressure on the ink bladder 308, air or other gas is introduced under pressure through air inlet 314. As the second bag 312 inflates it exerts fluid pressure on ink bag 308 so that pressurized ink is delivered to the print head.

Figure 11:
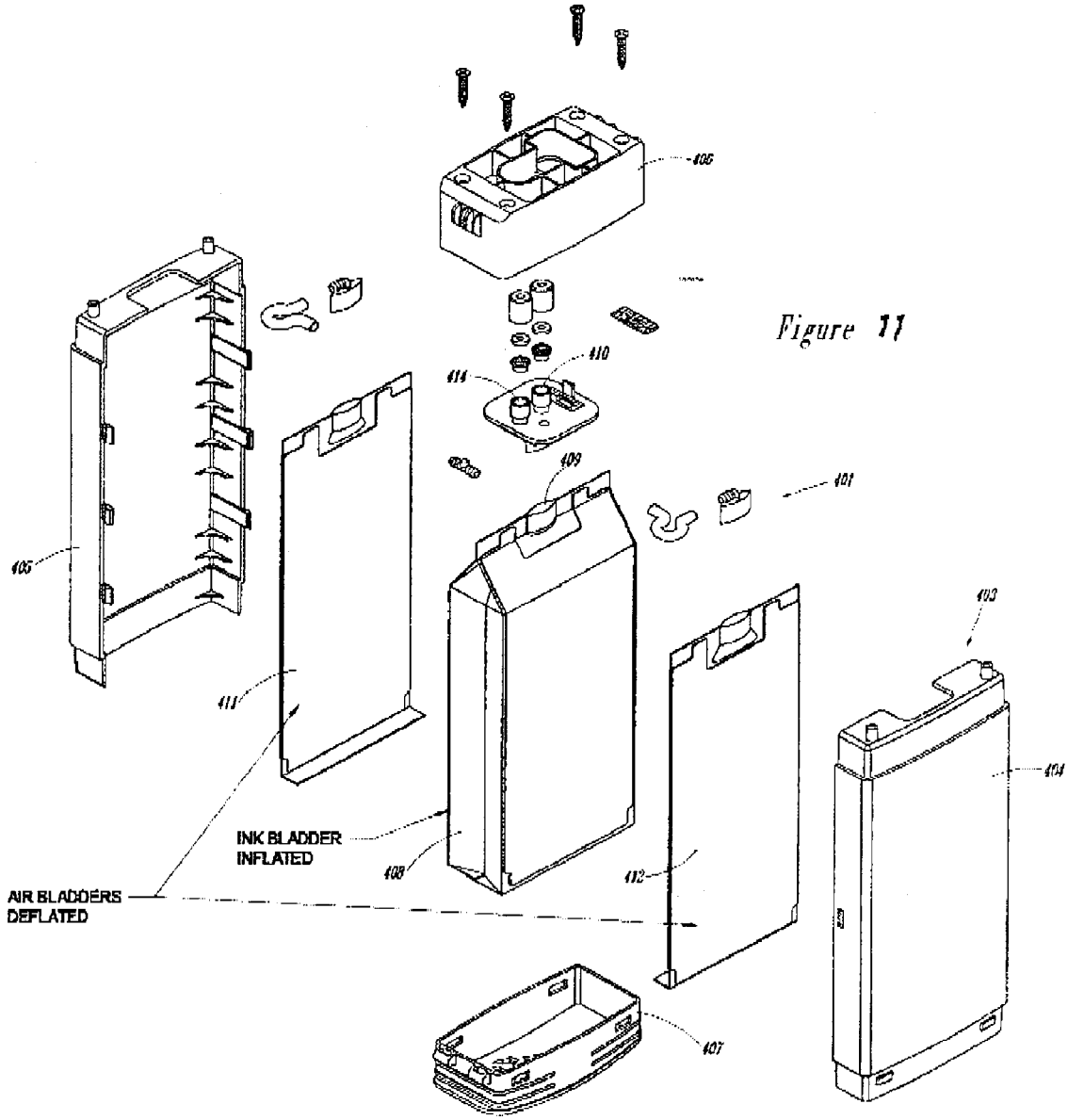
FIG. 11 is an assembly drawing of another embodiment of an ink cartridge having one ink bladder with two air bladders on either side of the ink bladder according to the present invention

In FIG. 11 another embodiment of ink cartridge, generally indicated at 401, according to the present invention is illustrated. The ink cartridge 401 has an outer casing, generally indicated at 403, having a pair of side wall sections 404, 405 and first and second end caps 406, 407. A bladder or bag 408 for the ink is provided within the interior of housing 403. A bag outlet 409 on the ink bladder 408 is connected to an ink outlet 410. A second pair of bags 411, 412 are provided adjacent opposite sides of the ink bladder 408. The second pair of bags 411, 412 are connected to air inlet 414. In order to provide pressure on the ink bladder 408, air or other gas is introduced under pressure through air inlet 414. As the second pair of bags 411, 412 inflate they exerts fluid pressure on ink bag 408 so that pressurized ink is delivered to the print head.

Figure 12:
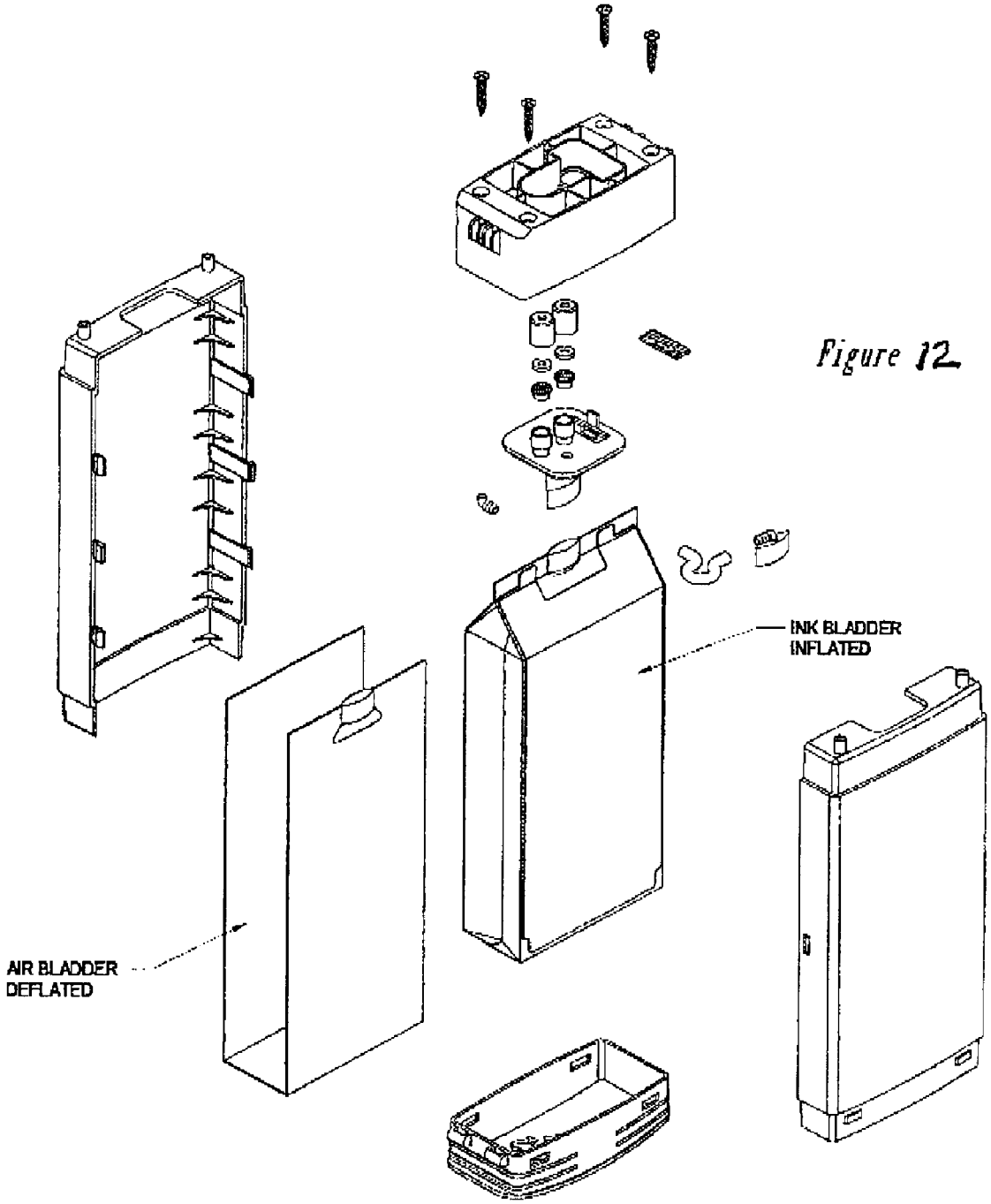
FIG. 12 is an assembly drawing of another embodiment of an ink cartridge having one ink bladder with one air bladder wrapped around both sides of the ink bladder according to the present invention.

In FIG. 12 the ink cartridge is provided similar to the embodiment shown in FIG. 11. In this embodiment there is a single air bag that wraps down both sides and underneath the ink bag.

Figure 13:
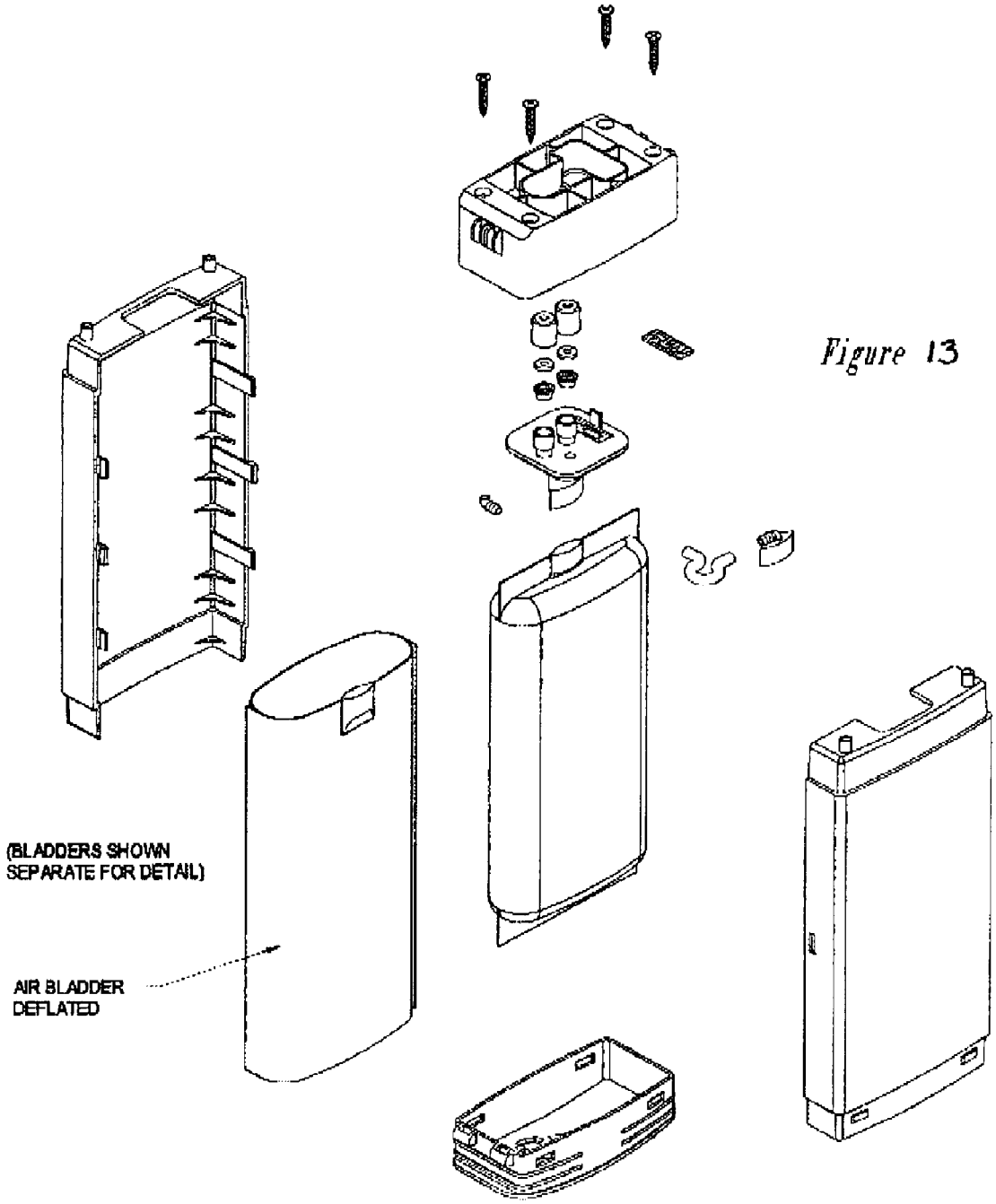
FIG. 13 is an assembly drawing of another embodiment of an ink cartridge having one ink bladder within an air bladder according to the present invention

In FIG. 13 the ink cartridge is provided similar to the embodiment shown in FIG. 10. In this embodiment there is a single air bag that forms a tube with the ink bag located within the air bag.

Figure 14:
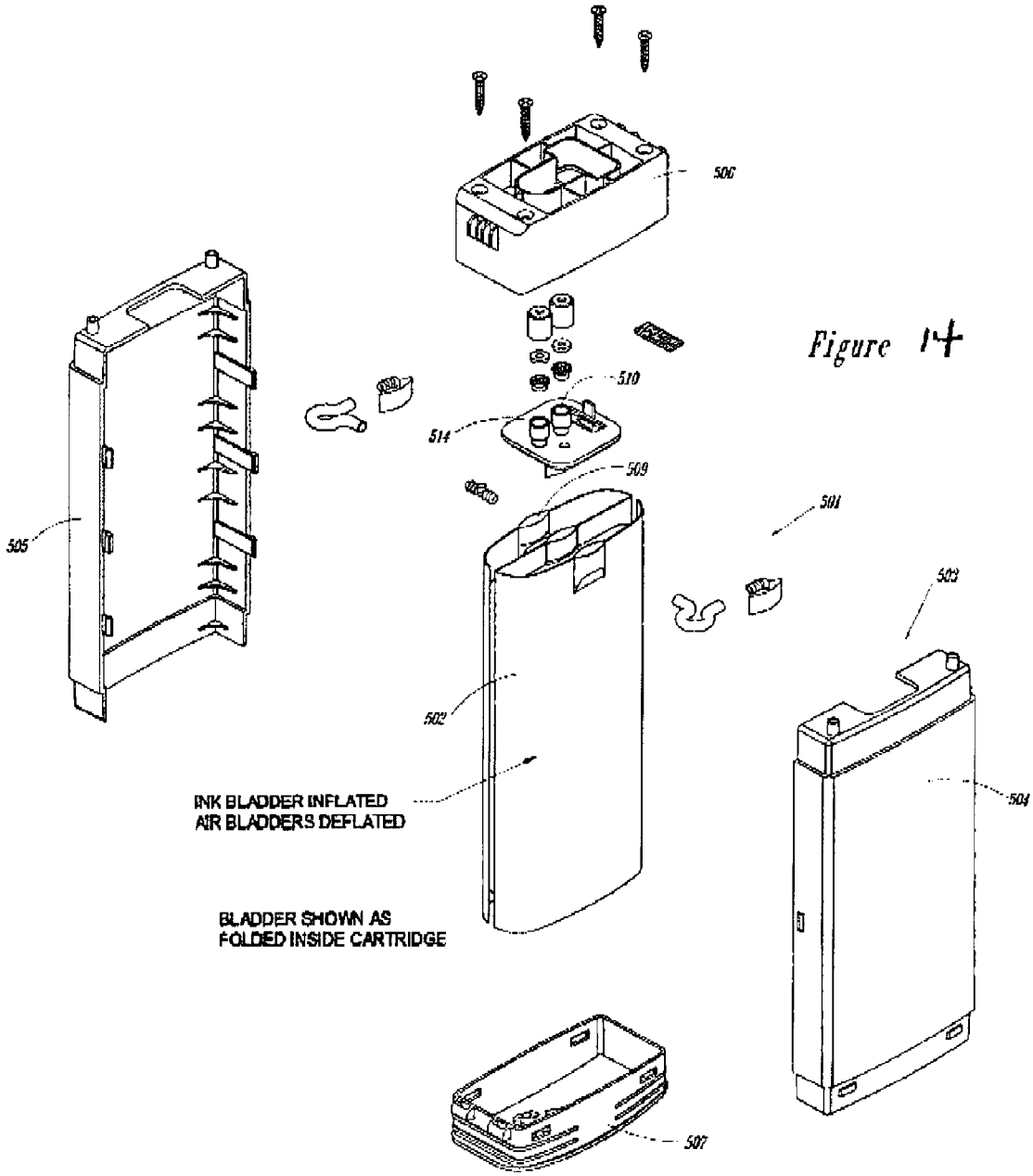
FIG. 14 is an assembly drawing of another embodiment of a refillable ink cartridge having one ink bladder with two air bladders on either side of the ink bladder where the one ink bladder and two air bladders are formed as an integral unit with three compartments according to another aspect of the present invention.
Figure 15:
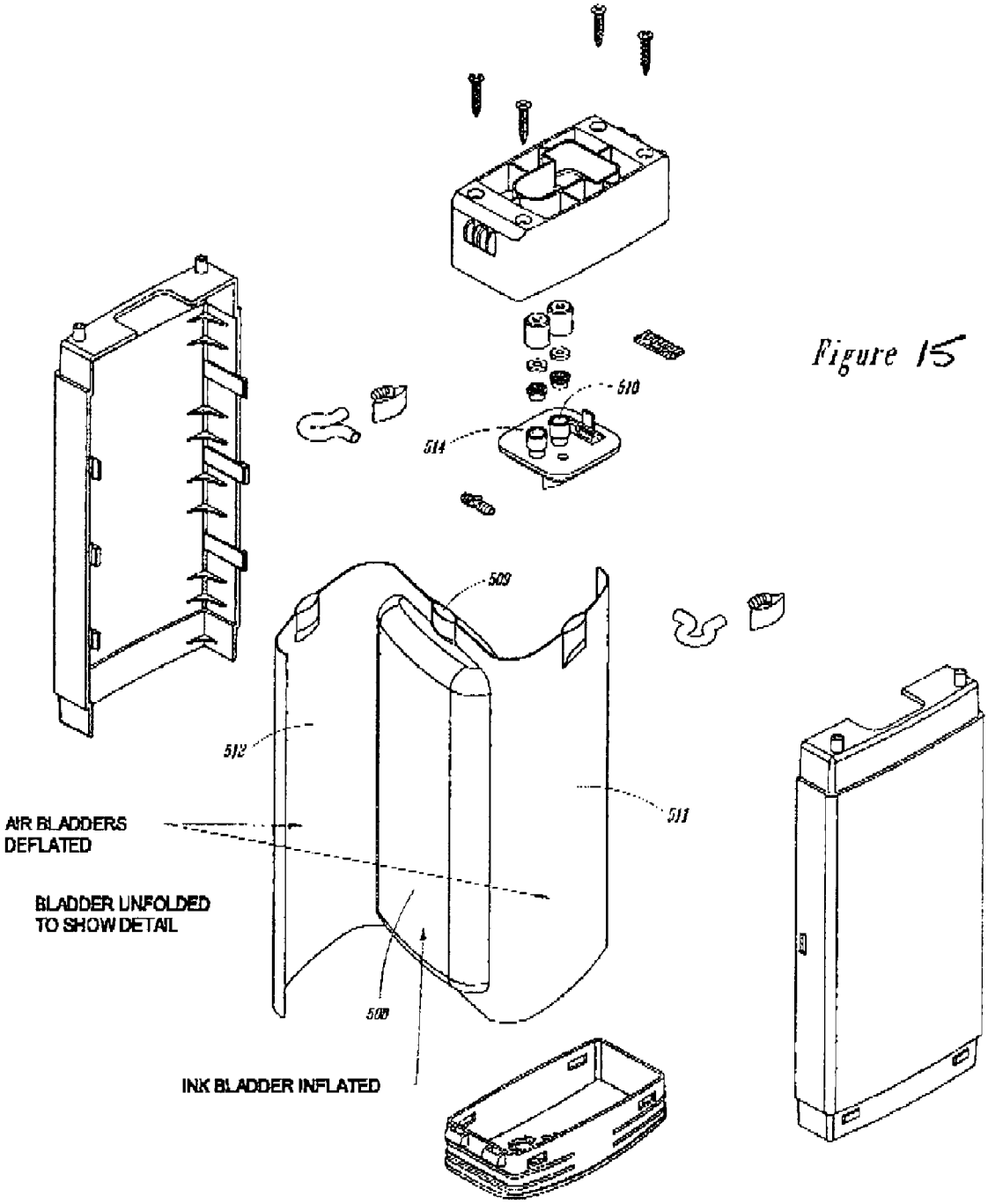
FIG. 15 is an assembly drawing of the ink cartridge of FIG. 13 showing the integral unit with three compartments partially unfolded.

In FIG. 14-15 another embodiment of ink cartridge, generally indicated at 501, according to the present invention is illustrated. The ink cartridge 501 is similar to the embodiment shown in FIG. 11 and has an outer casing, generally indicated at 503, having a pair of side wall sections 504, 505 and first and second end caps 506, 507. A bladder or bag 502 having a first compartment 508 for the ink is provided within the interior of housing 503. A ink compartment outlet 509 on the ink compartment 508 is connected to an ink outlet 510. A second pair of compartments 511, 512 are provided on bag 502 adjacent opposite sides of the ink compartment 508 (see FIG. 14). The second pair of compartments 511, 512 are connected to air inlet 514. In order to provide pressure on the ink compartment 508, air or other gas is introduced under pressure through air inlet 514. As the second pair of compartments 511, 512 inflate they exert fluid pressure on ink compartment 508 so that pressurized ink is delivered to the print head.

Figure 16:
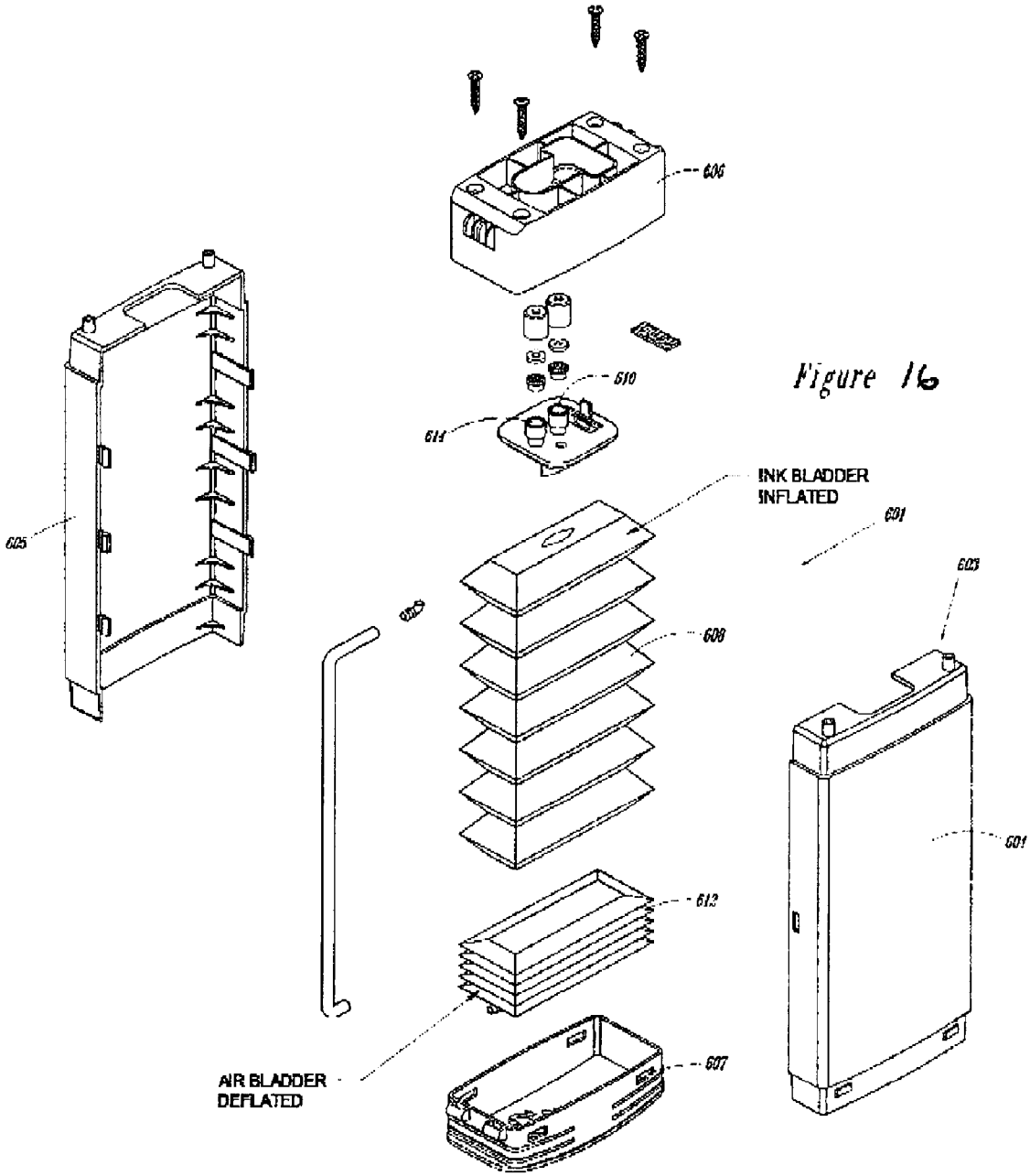
FIG. 16 is an assembly drawing of another embodiment of an ink cartridge having one full ink bladder with an air bladder at one end of the ink bladder according to the present invention.
Figure 17:
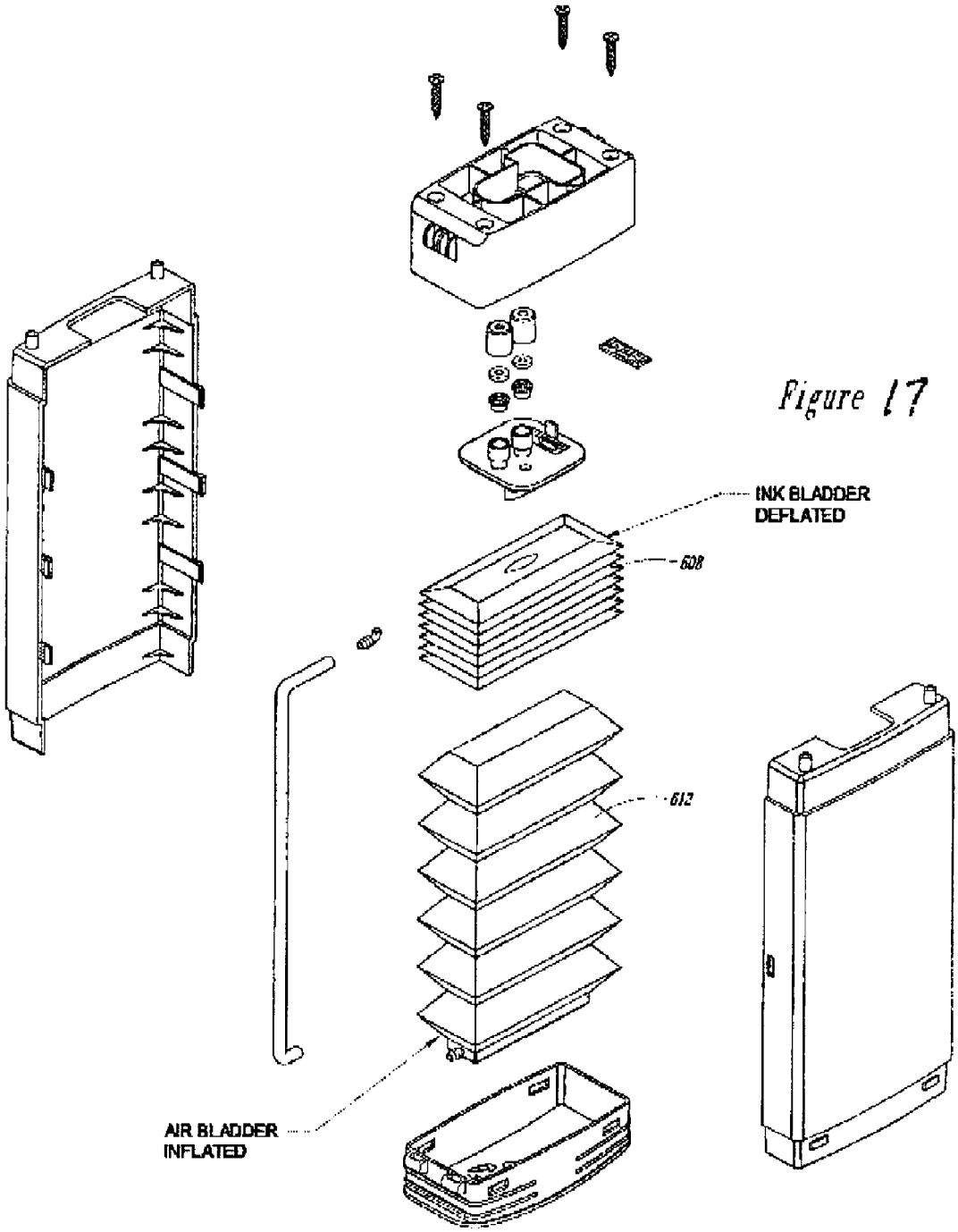
FIG. 17 is an assembly drawing of the ink cartridge of FIG. 16 showing the ink bladder emptied and the air bladder inflated.

In FIG. 16-17 a further embodiment of ink cartridge, generally indicated at 601, according to the present invention is illustrated. The ink cartridge 601 has an outer casing, generally indicated at 603, having a pair of side wall sections 604, 605 and first and second end caps 606, 607. A bag 608 in the form of bellows for the ink is provided within the interior of housing 603. A bag outlet 609 on the ink bag 608 is connected to an ink outlet 610. A second bag 612 also formed as a bellows is located adjacent an end of the ink bag 608. The second bag 612 is connected to air inlet 614. In order to provide pressure on the ink bag 608, air or other gas is introduced under pressure through air inlet 614. As the second hag 612 inflates it exerts fluid pressure on ink bag 608 so that pressurized ink is delivered to the print head.

The advantages of using the bladder type ink cartridges of the present invention are:

They are refillable lowering the impact to land fill.

The computer chip on the cartridge will allow multiple refills

They are easily repairable and the ink bladder bag would be the only part that will go to land fill The air bladders, cartridge case and end caps are 100% recyclable.

The air bladders are specifically designed to maximize the cartridge's ability to void up to 98% of the cartridge's ink. The current ink cartridges have a maximum void capacity of approximately 85 to 90% leaving valuable ink dollars in the cartridge, that winds up in land fill.

The ink and air bladder cartridge is designed to hold larger ink volumes than that of the manufactures original or replacement cartridge. This allows the consumer the ability to lower his ink supply costs by buying in larger discounted volumes and eliminating multiple delivery costs.

This larger volume ink and air bladder cartridge is designed to fit in all printing machines allowing the manufacture of the cartridge to lower the amount of different cartridge sizes in his inventory, this means that the ink and air bladder cartridge can be filled to its designed maximum milliliters/liters or filled to the consumers desired volume.

It is to be understood by one of ordinary skill in the art that the present discussion is a description of exemplary embodiments only, and is not intended to limit the broader aspects of the present invention.

Although various preferred embodiments of the present invention have been described herein in detail, it will be appreciated by those skilled in the art, that variations may be made thereto without departing from the spirit of the invention or the scope of the appended claims.

The embodiment of the invention in which an exclusive property or privilege is claimed are defined as follows:

1. An ink cartridge for large format printers that is refillable having a rigid outer casing, at least one ink compartment provided within the outer casing, an ink outlet connected to the at least one ink compartment, a plunger located in an end of each ink compartment remote from the ink outlet to exert pressure on the ink in the at least one ink compartment to enable pressurized ink to be delivered to the print head, wherein locking means are provided within the outer casing to lock the plunger in place once the cartridge is empty of ink and un-locking means to release the cartridge when the cartridge is refilled.

2. An ink cartridge according to claim 1 wherein the outer casing has a side wall section and first and second end caps, at least one ink compartment is defined between the side wall section and one or more interior walls.

3. An ink cartridge according to claim 2 wherein the one ink compartment is defined between the side wall section of the outer casing.

4. An ink cartridge according to claim 3 wherein the ink compartment has a generally rectangular cross section.

5. An ink cartridge according to claim 3 wherein the ink compartment has a generally elliptical cross section.

6. An ink cartridge according to claim 2 wherein two ink compartments are defined between the side wall section of the outer casing and one or more interior walls.

7. An ink cartridge according to claim 6 wherein each of the ink compartments has a generally circular cross section.

8. An ink cartridge according to claim 1 wherein the plunger is pushed through the ink towards the ink outlet by air pressure or other suitable biasing means.

9. An ink cartridge according to claim 1 wherein the ink cartridge is made of recyclable materials.

10. An ink cartridge according to claim 1 wherein the ink cartridge is provided with a programmable chip to interface with a printer.

11. An ink cartridge according to claim 10 wherein the chip is programmed to permit the filing or refilling of the cartridge to be monitored and controlled by an ink filing apparatus.

12. An ink cartridge according to claim 1 wherein the ink cartridge is made of recyclable materials.

13. An ink cartridge for large format printers that is refillable having a rigid outer casing, at least one ink compartment provided within the outer casing, an ink outlet connected to the at least one ink compartment, means to exert pressure on the ink in the at least one ink compartment to enable pressurized ink to be delivered to the print head wherein the ink cartridge is adapted to include moveable locking tabs provided on an exterior of the rigid outer casing to enable the ink cartridge to be compatible with different sizes of printers and to permit larger volume ink cartridges to be used said locking tabs mounted on a base plate that slides on a side wall of the rigid outer casing to position the locking tabs to engage with corresponding tabs on a printer.

* * * * *